US008201912B2

(12) United States Patent
Iwase et al.

(10) Patent No.: US 8,201,912 B2
(45) **Date of Patent: *Jun. 19, 2012**

(54) LIQUID JET RECORDING APPARATUS, LIQUID JET HEAD UNIT, AND LIQUID JET RECORDING METHOD

(75) Inventors: Fumiyoshi Iwase, Shizuoka-ken (JP); Tetsuya Murase, Chiba (JP); Masatoshi Toda, Chiba (JP)

(73) Assignee: SII Printek Inc. (JP)

( * ) Notice: Subject to any disclaimer, the term of this patent is extended or adjusted under 35 U.S.C. 154(b) by 357 days.

This patent is subject to a terminal disclaimer.

(21) Appl. No.: 12/583,957

(22) Filed: Aug. 28, 2009

(65) Prior Publication Data

US 2010/0053242 A1 Mar. 4, 2010

(30) Foreign Application Priority Data

Aug. 29, 2008 (JP) ..... 2008-221652

(51) Int. Cl.
*B41J 29/38* (2006.01)

(52) U.S. Cl. ..... 347/17

(58) Field of Classification Search ..... 347/5, 9, 347/17, 84, 85
See application file for complete search history.

(56) References Cited

U.S. PATENT DOCUMENTS 7,407,241 B2 * 8/2008 Mutoh et al. ..... 347/5
7,517,032 B2 * 4/2009 Nottelman et al. ..... 347/5

* cited by examiner

*Primary Examiner* — An Do
(74) *Attorney, Agent, or Firm* — Adams & Wilks

(57) ABSTRACT

A liquid jet recording apparatus adjusts the pressure of liquid jetted from a jetting portion toward a recording medium. The liquid jet recording apparatus has a pressure sensor provided in a tube between a liquid storing portion and a roller tube pump. The pressure of the liquid which flows through the tube is measured, and a pressure value is sent to a control portion. The pressure value is compared with lower limit values and upper limit values stored in a definition file stored in the control portion, and a corresponding drive signal is sent to a drive portion to drive the roller tube pump in a forward or a reverse direction to adjust the pressure of the liquid in the jetting portion.

13 Claims, 5 Drawing Sheets

LIQUID JET RECORDING APPARATUS, LIQUID JET HEAD UNIT, AND LIQUID JET RECORDING METHOD

BACKGROUND OF THE INVENTION

1. Field of the Invention

The present invention relates to a liquid jet recording apparatus, a liquid jet head unit, and a liquid jet recording method.

2. Description of the Related Art

Conventionally, as an apparatus for jetting liquid toward a recording medium, a liquid jet recording apparatus for jetting a droplet from a plurality of nozzles toward a recording medium is known. As such a liquid jet recording apparatus, for example, one having a liquid jet head mounted thereon for jetting toward a recording medium a droplet of several to several ten picoliters is known. A liquid jet head which jets such a minute droplet is adapted to control liquid in the nozzle so as to be optimum for being jetted in order to materialize satisfactory jetting of the liquid. Here, a state of liquid which is optimum for being jetted is a state in which the pressure of the liquid in the nozzle is a negative pressure and a meniscus is formed in the nozzle. In order to make such a pressure adjustment, an apparatus is known in which a pump or an air valve is provided in a flow path of liquid between a liquid container and a liquid jet head for adjusting the pressure.

Japanese Patent Application Laid-Open No. 2005-34999 describes an ink jet printer including a pump for depressurizing liquid in a nozzle of a liquid jet head, an air communication valve for pressurizing liquid in the nozzle of the liquid jet head, a pressure sensor for measuring the pressure of liquid in the nozzle of the liquid jet head, and a control portion for operating the pump and the air communication valve based on a measured value by the pressure sensor. In the ink jet printer, the pressure of liquid to be supplied to the nozzle is adapted to be increased or decreased by the pump and the air communication valve disposed in a liquid flow path from an auxiliary tank for storing liquid to the liquid jet head.

However, the ink jet printer described in Japanese Patent Application Laid-Open No. 2005-34999 has a problem that, both the pump and the air communication valve are necessary for increasing and decreasing the pressure of the liquid in the nozzle, and hence the structure of the apparatus is complicated.

Further, as an ink jet printer in recent years, a large printing apparatus which can print a large area of a surface of a poster or a signboard is often used, and there is a tendency to enlarge the apparatus in a specific field. In such a large printing apparatus, compared with a case of a small printing apparatus, the distance from a liquid container for storing liquid to be jetted to a liquid jet head is larger, and thus, the length of a flow path for supplying the liquid to the liquid jet head is larger. Therefore, in a large apparatus, the loss of pressure on the liquid in the flow path increases, and the liquid may be prevented from being supplied to the liquid jet head with the pressure thereon being held appropriate for the liquid jet environment. In order to precisely set the pressure value of liquid in the liquid jet head, it is necessary to precisely measure the pressure value in the liquid jet head and to supply the liquid with appropriate pressure thereon being held.

Further, when a carriage including a liquid jet head scans a range to be printed, the position of a flow path for communicating a liquid container with the liquid jet head repeatedly changes as the carriage moves, and hence liquid existing in the flow path is under a pressure load. In this case, liquid affected by the pressure load is supplied to the liquid jet head which is located downstream from the flow path, and thus, it is difficult to hold the appropriate pressure for the liquid jet environment. Normally, such a pressure load on liquid is reduced by a pressure damper (liquid storing portion), however, pressure loss due to the increased length of the flow path still affects the liquid, which prevents materialization of an appropriate printing environment.

Further, as the range to be printed increases as described above, the range to be scanned by the carriage including the liquid jet head also increases, and thus, liquid having the amount beyond the ability of the pressure damper to decrease the pressure load may be supplied to the liquid jet head, and thus, deterioration of the printing environment is expected as the apparatus becomes larger.

As described above, in order to prepare a sophisticated printing environment for a printer, it is an urgent necessity to precisely measure and grasp the pressure of liquid in the liquid jet head.

SUMMARY OF THE INVENTION

The present invention has been made in view of the above, and an object of the present invention is to provide a liquid jet recording apparatus and a liquid jet head unit which have a function of adjusting pressure of liquid jetted from a jetting portion toward a recording medium and which still have a simple apparatus structure.

In order to solve the problem described above, the present invention proposes the following means.

According to a first aspect of the present invention, there is provided a liquid jet recording apparatus including: a liquid container for containing liquid; a jetting portion for jetting the liquid toward a recording medium; a liquid conduit for communicating the jetting portion with the liquid container; pressure adjusting means disposed on a middle portion of the liquid conduit, for adjusting pressure of the liquid which flows through the liquid conduit; a liquid storing portion disposed in the liquid conduit between the pressure adjusting means and the jetting portion, for damping pressure fluctuations of the liquid which flows in from one end thereof and making the liquid flow to another end thereof; pressure measuring means disposed in the liquid conduit between the liquid storing portion and the pressure adjusting means, for measuring the pressure of the liquid which flows through the liquid conduit; and a control portion electrically connected to the pressure measuring means and the pressure adjusting means, in which the control portion includes a setting portion for indicating the pressure fluctuations of the liquid from a position at which a measurement is made by the pressure measuring means via the liquid storing portion to the jetting portion, and, based on information set in the setting portion and a pressure value measured by the pressure measuring means, controls the pressure adjusting means so that the pressure of the liquid in the jetting portion is in a predetermined range.

According to the present invention, the pressure of the liquid which flows through the liquid conduit from the liquid container to the jetting portion is measured by the pressure measuring means. The control portion generates a drive signal to the pressure adjusting means based on the pressure value stored in the setting portion and the pressure value of the liquid measured by the pressure measuring means such that the pressure of the liquid is damped by the liquid conduit and the liquid storing portion to be in a predetermined range in the jetting portion. The pressure adjusting means sends under pressure the liquid which flows through the liquid conduit toward the jetting portion or toward the liquid container according to the drive signal generated by the control portion to change the pressure of the liquid which flows through the liquid conduit.

According to a second aspect of the present invention, the liquid jet recording apparatus further includes a branch conduit disposed in a part of the liquid conduit between the pressure adjusting means and the liquid storing portion. In the liquid jet recording apparatus, the pressure measuring means is connected to a tip of the branch conduit and is connected via the branch conduit to the liquid conduit.

According to the present invention, because the pressure measuring means is disposed via the branch conduit so as to be apart from the liquid conduit, the pressure measuring means has a higher degree of flexibility in installation thereof.

According to a third aspect of the present invention, in the liquid jet recording apparatus, the pressure measuring means is connected adjacently to the liquid storing portion disposed in the liquid conduit.

According to the present invention, because the pressure measuring means measures the pressure of the liquid which flows near the liquid storing portion of the liquid conduit, pressure which reflects pressure loss and pressure fluctuations due to the liquid conduit from the pressure adjusting means to the neighborhood of the liquid storing portion is measured.

According to a fourth aspect of the present invention, in the liquid jet recording apparatus, the pressure measuring means is connected adjacently to the pressure adjusting means of the liquid conduit.

According to the present invention, because the pressure measuring means is disposed on the side of the pressure adjusting means in the liquid conduit, the scanning efficiency of a carriage including the liquid storing portion and the jetting portion can be improved. More specifically, because the carriage does not include the pressure measuring means, the weight of the carriage can be reduced, and thus, the amount of energy used by the carriage in scanning can be reduced.

According to a fifth aspect of the present invention, the liquid jet recording apparatus further includes a carriage, the jetting portion being fixed to and supported by the carriage and the carriage being movable above the recording medium. In the liquid jet recording apparatus, the liquid storing portion is fixed to the carriage.

According to the present invention, because the liquid storing portion is disposed on the carriage, the liquid storing portion damps the pressure fluctuations of the liquid caused by movement of the carriage above the recording medium and supplies the liquid to the jetting portion. Here, because the range of the pressure of the liquid which can be damped by the liquid storing portion is stored in the control portion, the pressure of the liquid supplied to the jetting portion is adjusted by the pressure measuring means, the control portion, and the pressure adjusting means to be in a range which can be damped by the liquid storing portion and the liquid conduit.

According to a sixth aspect of the present invention, in the liquid jet recording apparatus, the liquid storing portion is fixed to a liquid supply mechanism including the liquid container and the pressure adjusting means.

According to the present invention, because the liquid storing portion is provided in the liquid supply mechanism, the weight of the carriage including the jetting portion can be reduced, the scanning efficiency of the carriage can be improved, and the amount of energy used by the carriage in scanning can be reduced.

According to a seventh aspect of the present invention, in the liquid jet recording apparatus, the liquid storing portion is disposed adjacently to the pressure adjusting means of the liquid conduit.

According to the present invention, the liquid storing portion and the pressure measuring means are disposed in a part of the liquid conduit on the side of the pressure adjusting means. Here, because the range of the pressure of the liquid which can be damped by the liquid storing portion and the liquid conduit is stored in the control portion, the pressure of the liquid supplied to the jetting portion is adjusted by the pressure measuring means, the control portion, and the pressure adjusting means to be in a range which can be damped by the liquid storing portion and the liquid conduit.

According to an eighth aspect of the present invention, in the liquid jet recording apparatus, the setting portion includes a table indicating a relationship between the pressure value measured by the pressure measuring means and a pressure value of the liquid in the jetting portion.

According to the present invention, the table converts the pressure value of the liquid measured by the pressure measuring means to the pressure value of the liquid in the jetting portion. Therefore, based on the pressure value measured by the pressure measuring means, the pressure value in the jetting portion is estimated, and the pressure adjusting means can adjust the pressure of the liquid in the jetting portion.

According to a ninth aspect of the present invention, there is provided a liquid jet head unit used in the liquid jet recording apparatus according to any one of the first to third aspects of the present invention, including: the jetting portion; the liquid storing portion; and the pressure measuring means, in which the jetting portion, the liquid storing portion, and the pressure measuring means are fixed and supported so as to be adjacent to one another.

According to the present invention, because the jetting portion, the liquid storing portion, and the pressure measuring means are unitized at high density, increase of the occupied space due to provision of the pressure measuring means is suppressed.

According to a tenth aspect of the present invention, a liquid jet recording method uses the liquid jet recording apparatus according to any one of the first to eighth aspects of the present invention, and includes: monitoring the pressure value indicated by the pressure measuring means, and measuring the pressure of the liquid; determining whether or not the pressure of the liquid is between an upper limit pressure value and a lower limit pressure value which are set in advance; and stopping operation of the pressure adjusting means when the pressure of the liquid is between the upper limit pressure value and the lower limit pressure value, pressurizing the liquid toward a nozzle by the pressure adjusting means when the pressure of the liquid is lower than the lower limit pressure value, and pressurizing the liquid toward the liquid container by the pressure adjusting means when the pressure of the liquid is higher than the upper limit pressure value.

According to the present invention, first, the pressure measuring means measures the pressure of the liquid which is on the side of the pressure adjusting means from the liquid storing portion. Then, the control portion determines whether or not the pressure of the liquid is between the upper limit pressure value and the lower limit pressure value. Here, when the pressure is between the upper limit pressure value and the lower limit pressure value and the pressure adjusting means is operational, the control portion stops the pressure adjusting means. On the other hand, when the pressure of the liquid is lower than the lower limit pressure value, the control portion drives the pressure adjusting means to pressurize the liquid toward the jetting portion, thereby decreasing the negative pressure generated in the nozzle. When the pressure of the liquid is higher than the upper limit pressure value, the control portion drives the pressure adjusting means to pressurize the liquid toward the liquid container. In this way, the control portion drives the pressure adjusting means to appropriately adjust the pressure of the liquid in the nozzle.

According to an eleventh aspect of the present invention, in the liquid jet recording method, the upper limit pressure value and the lower limit pressure value are set with regard to the pressure value of the liquid in the nozzle.

According to the present invention, the pressure value of the liquid in the nozzle is controlled to be between the upper limit pressure value and the lower limit pressure value, and hence the pressure of the liquid is adjusted such that the liquid is satisfactorily jetted from the nozzle independently of the location at which the pressure measuring means measures the pressure of the liquid.

According to a twelfth aspect of the present invention, in the liquid jet recording method, the upper limit pressure value is +0.5 kPa and the lower limit pressure value is −2.0 kPa.

According to the present invention, when the upper limit pressure value is +0.5 kPa or more, the liquid leaks from the nozzle of the jetting portion, and hence it is difficult to jet the liquid as a droplet. On the other hand, when the lower limit pressure value is −2.0 kPa or less, the liquid is not sufficiently supplied to the nozzle of the jetting portion. By controlling the pressure of the liquid to be in a range of +0.5 kPa to −2.0 kPa, a meniscus surface by the liquid is formed in the nozzle of the jetting portion, and the liquid can be jetted by the jetting portion as a droplet toward the recording medium. Further, by controlling the pressure of the liquid to have a range of +0.5 kPa to −2.0 kPa, an excessive pressure adjustment made by frequently reversing the control from increasing the pressure to decreasing the pressure and vice versa by the control portion is suppressed.

According to a thirteenth aspect of the present invention, in the liquid jet recording method, the upper limit pressure value is −0.5 kPa and the lower limit pressure value is −1.0 kPa.

According to the present invention, the upper limit pressure value is a negative pressure, and hence a meniscus surface by the liquid is formed in the nozzle, and the liquid can be satisfactorily jetted as a droplet. Further, the lower limit pressure value is −1.0 kPa, and hence the difference between the upper limit pressure value and the lower limit pressure value is small and variations in the shape of the droplet is suppressed, which leads to a satisfactory result of jetting.

According to a liquid jet recording apparatus and a liquid jet head of the present invention, by measuring the pressure of the liquid which flows through the liquid conduit between the liquid storing portion and the pressure adjusting means and by driving the pressure adjusting means such that the pressure is in a pressure range stored in a pressure map to make a pressure adjustment, it is made possible to maintain the function of adjusting the pressure of the liquid jetted from the jetting portion toward a recording medium and to, still, simplify the apparatus structure.

DETAILED DESCRIPTION OF THE INVENTION

First Embodiment

Figure 1:
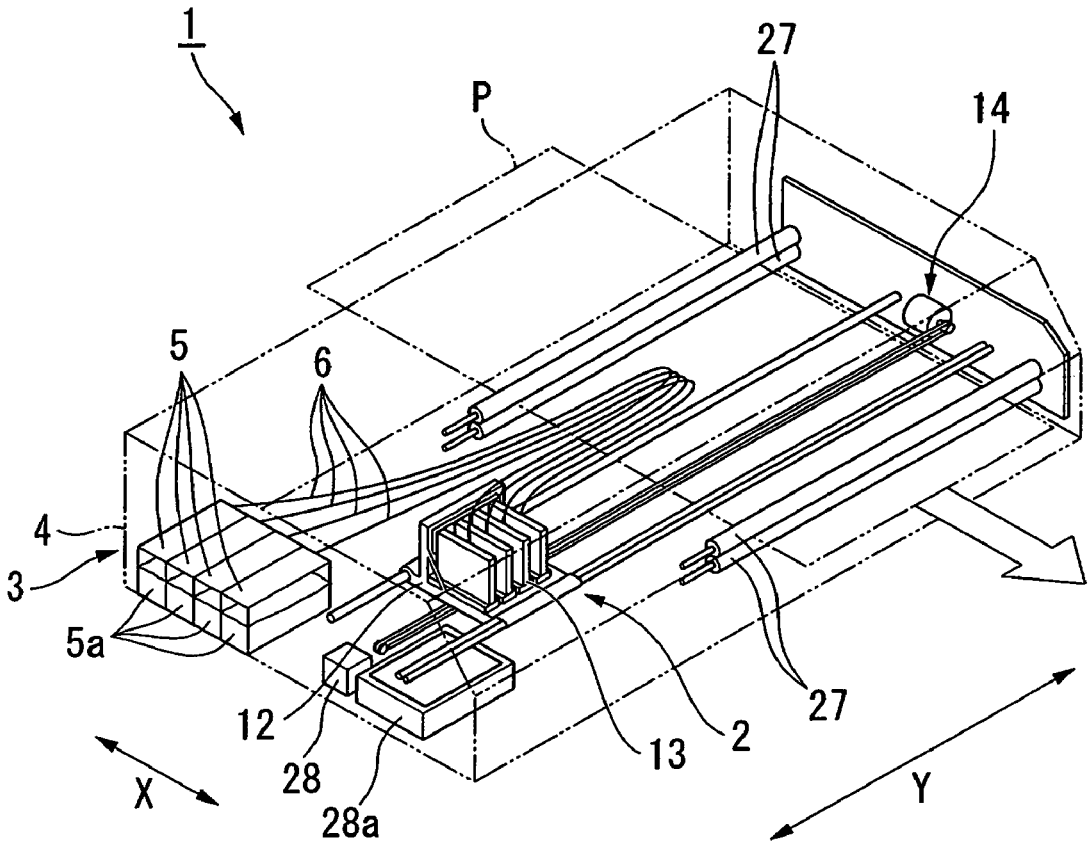
FIG. 1 is an explanatory view for describing a structure of a liquid jet recording apparatus according to the present invention.
Figure 2:
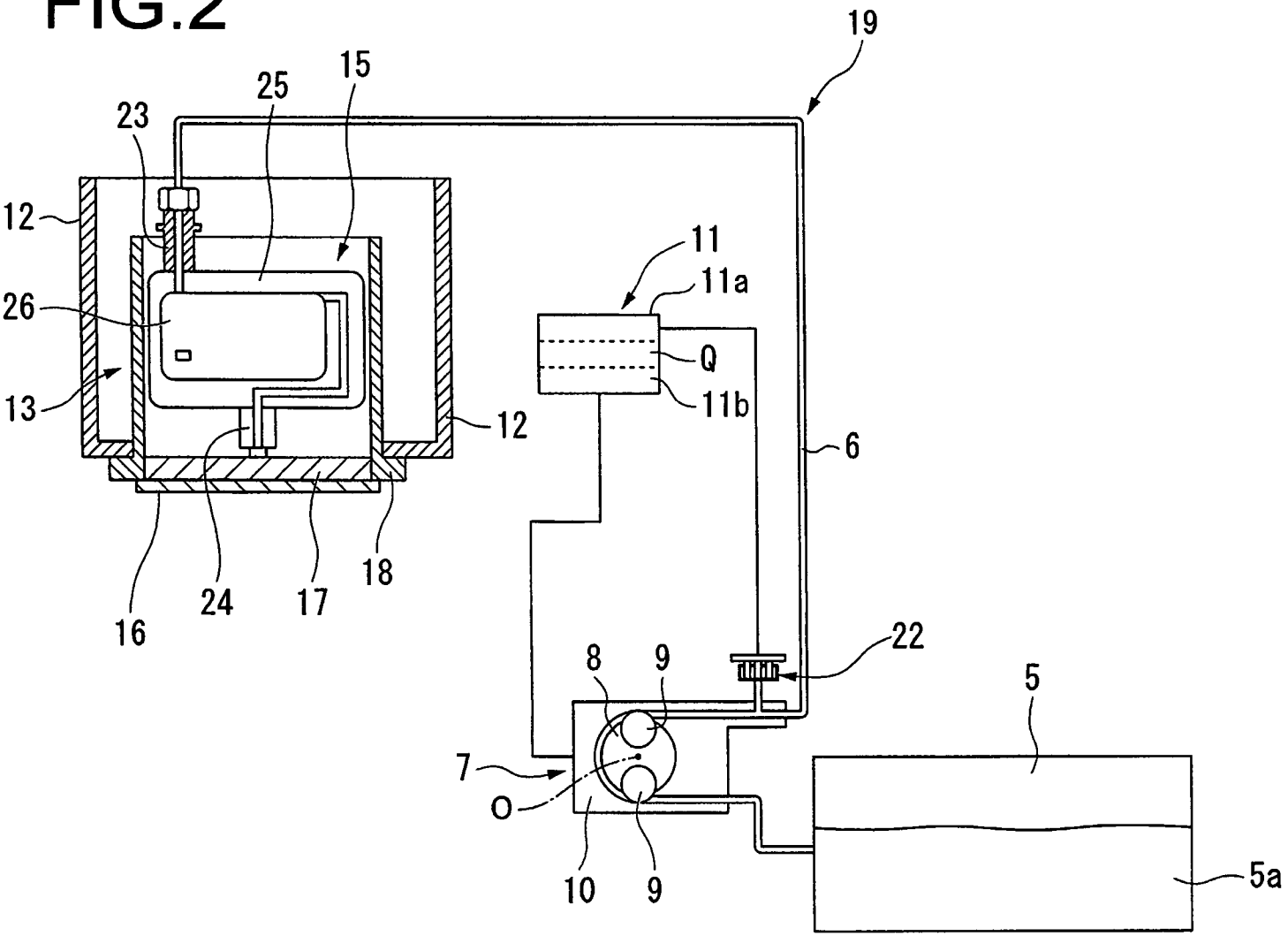
FIG. 2 is an explanatory view for describing a flow path of liquid in a liquid jet recording apparatus according to a first embodiment of the present invention.
Figure 3:
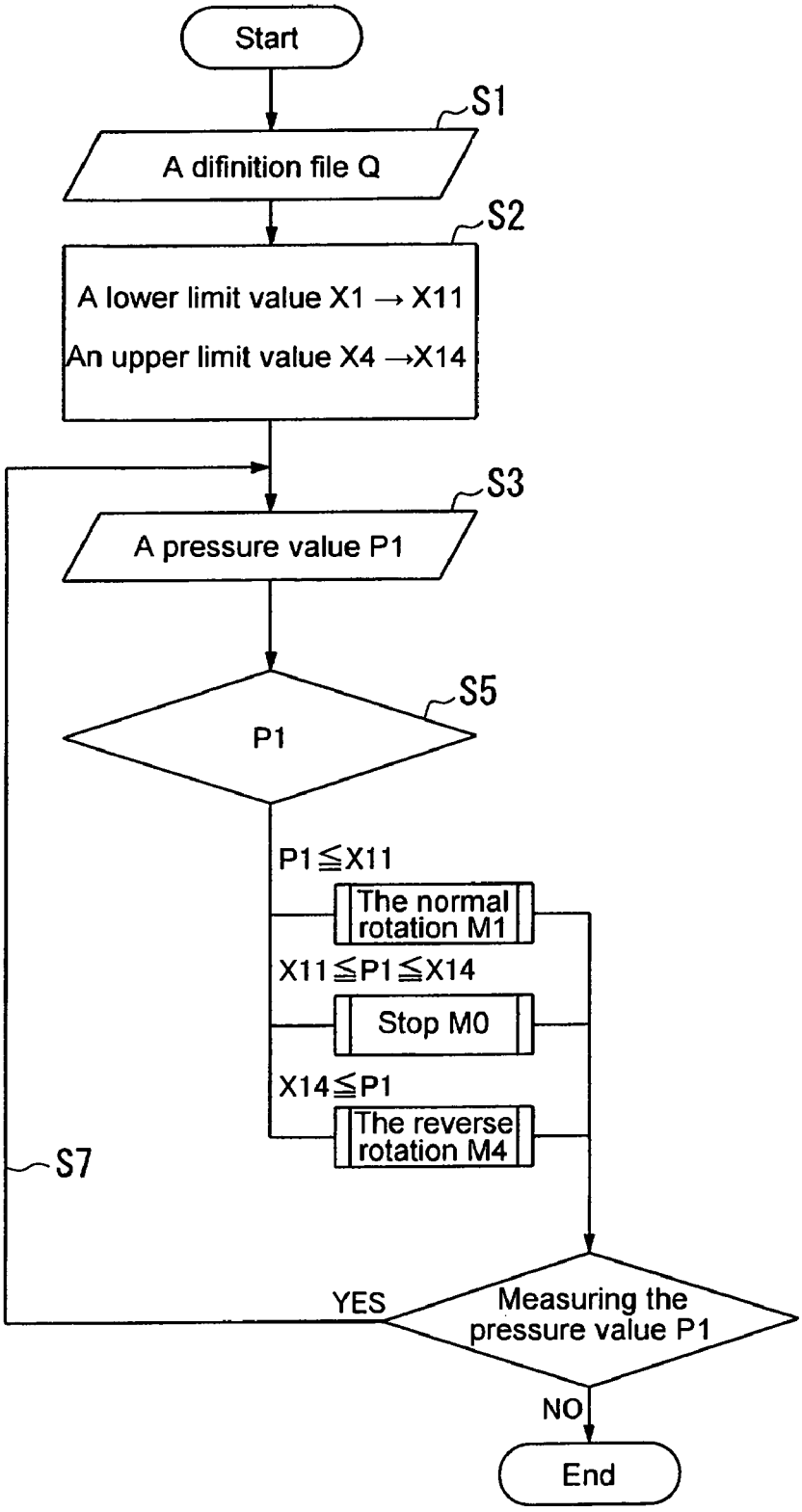
FIG. 3 is a flow chart for describing control of the pressure of liquid in the liquid jet recording apparatus according to the present invention.

A liquid jet recording apparatus according to a first embodiment of the present invention is now described in the following with reference to FIGS. 1 to 3. FIG. 1 is an explanatory view for describing a structure of the liquid jet recording apparatus. Further, FIG. 2 is an explanatory view for describing a flow path of liquid in the liquid jet recording apparatus. FIG. 3 is a flow chart for describing control of the pressure of liquid in the liquid jet recording apparatus.

First, the liquid jet recording apparatus having a liquid jet head mounted thereon according to this embodiment is described.

As illustrated in FIGS. 1 and 2, a liquid jet recording apparatus 1 includes in a frame 4, a liquid jet mechanism 2 for jetting liquid 5*a* toward a recording medium P such as a paper sheet, a liquid supply mechanism 3 for supplying the liquid 5*a* to the liquid jet mechanism 2, a transfer mechanism 27 for transferring the recording medium P in directions indicated by arrows X in FIG. 1 below the liquid jet mechanism 2, and a control portion 11 electrically connected to the respective mechanisms described above. The liquid supply mechanism 3 includes a liquid container 5 for storing the liquid 5*a*, a flexible tubular tube 6 having one end connected to the liquid container 5, and a roller tube pump 7 as pressure adjusting means disposed at a middle portion of the tube 6.

The roller tube pump 7 includes a motor (not shown), a substantially cylindrical wheel 8 having a center of rotation 0 connected to a drive shaft of the motor as illustrated in FIG. 2, rollers 9 rotatably engaged with an outer peripheral portion of the wheel 8, and a case member 10 having an arc-like groove formed thereon for engaging with the tube 6. The rollers 9 are adapted to press a part of the tube 6 in engagement with the case member 10. By pressing the tube 6 with the rollers 9 while the wheel 8 is rotating, the liquid 5*a* in the tube 6 is pressurized in the rotational direction of the wheel 8 to send the liquid 5*a* toward or away from the liquid container 5 side. In this embodiment, the roller tube pump 7 is adapted to both send the liquid 5*a* and increase/decrease the pressure. The motor is electrically connected to the control portion 11.

Further, a pressure sensor 22 is provided at the case member 10 of the roller tube pump 7. The pressure sensor 22 is branched from and connected with the tube 6 on the side of the liquid jet mechanism 2. The pressure sensor 22 is electrically connected to the control portion 11.

The liquid jet mechanism 2 includes a carriage 12 which is movably disposed above the recording medium P and a liquid jet head unit 13 fixed to the carriage 12 for jetting the liquid 5*a* toward the recording medium P side. The carriage 12 is held by a moving mechanism 14 for reciprocating the carriage 12 in directions indicated by arrows Y in FIG. 1 above the recording medium P.

The liquid jet head unit 13 includes a liquid storing portion unit 15 having one end connected to the tube 6 for damping pressure fluctuations of the liquid 5*a*, a jetting portion 17 with a nozzle surface 16 having a plurality of nozzles for jetting the liquid 5*a* in minute droplets disposed therein, and a first support portion 18 for fixing the liquid storing portion unit 15 and the jetting portion 17 so as to be adjacent to each other. The inside space of the tube 6, the liquid storing portion unit 15, and the jetting portion 17 is a liquid conduit 19 through which the liquid 5*a* flows.

The liquid storing portion unit 15 includes a liquid storing portion case 25 having communicating portions 23 and 24 connected to the tube 6 and the jetting portion 17, respectively, and a substantially bag-like liquid storing portion 26 which is engaged with a recess portion formed in a middle portion of the liquid storing portion case 25 and is connected to the communicating portions 23 and 24. By adhering by thermal welding or the like a thin-film-like material for suppressing permeability to gas to a frame portion of the liquid storing portion case which is a peripheral portion of the recess portion, a liquid storing chamber for storing the liquid is formed, thereby forming the above-described liquid storing portion 26. The liquid storing chamber in the liquid storing portion 26 communicates with a tube 6 via the communicating portion 23. Such a liquid storing portion unit 15 makes it possible to adsorb pressure fluctuations accompanying the carriage movement.

The control portion 11 includes a determining portion 11*a* for monitoring the operation of the pressure sensor 22, receiving a pressure value P1 sent from the pressure sensor 22, and generating a drive signal M based on the pressure value P1, a drive portion 11*b* for receiving the drive signal M generated by the determining portion 11*a* and driving the roller tube pump 7, and a definition file Q in which a lower limit value X1 and an upper limit value X4 are electromagnetically stored as target values of the pressure for the purpose of carrying out satisfactory jetting by the jetting portion 17. The definition file Q is stored in a rewritable nonvolatile memory circuit such as a flash memory or an EPROM (not shown) in the control portion 11, and can be updated as necessary.

The lower limit value X1 and the upper limit value X4 are values which are defined in advance based on a lower limit value X2 (−1.0 kPa in this embodiment) and an upper limit value X3 (−0.5 kPa in this embodiment) of the pressure value at the nozzle surface of the jetting portion 17 and taking into consideration the damping ability of the liquid conduit 19 from the pressure sensor 22 to the jetting portion 17 and of the liquid storing portion 26, and are values which are calculated based on the inherent damping characteristics of the liquid conduit 19 and of the liquid storing portion 26, or are values which are obtained by actually measuring the pressure value in the jetting portion 17 and the pressure value in the pressure sensor 22.

The determining portion 11*a* determines whether or not the pressure value P1 is in a range which can be damped by the liquid conduit 19 from the pressure sensor 22 to the jetting portion 17 by comparing the lower limit value X1 and the upper limit value X4 which are the target values for pressure control with the pressure value P1.

The drive portion 11*b* drives the roller tube pump 7 according to a drive signal received from the determining portion 11*a*. The normal rotation M1 and the reverse rotation M4 are driving methods used in recovering operation from pressure fluctuations of the liquid 5*a*. The normal rotation M1 drives the wheel 8 in a normal direction while the reverse rotation M4 drives the wheel 8 in a reverse direction.

It is to be noted that the normal rotation of the roller tube pump 7 as used herein is in a direction in which the tube 6 is squeezed from the side of the liquid container 5 to the side of the jetting portion 17, while the reverse rotation as used herein is in a direction in which the tube 6 is squeezed from the side of the jetting portion 17 to the side of the liquid container 5.

Operation of the liquid jet recording apparatus 1 according to this embodiment having the structure described above is now described with reference to FIGS. 2 and 3.

First, an operator operates a power switch (not shown) for starting operation of the liquid jet recording apparatus 1 to turn the power on. Then, an initializing process (not shown) starts in an organizing portion (not shown) for organizing the whole operation of the liquid jet recording apparatus 1, and mechanisms including the liquid jet mechanism 2, the liquid supply mechanism 3, the transfer mechanism 27, and the control portion 11 are activated. Here, in the control portion 11, the definition file Q is read by the determining portion 11*a*, and the lower limit value X1 and the upper limit value X4 are assigned to a variable X11 and a variable X14, respectively.

Next, the operator supplies the recording medium P to the transfer mechanism 27, and positions the recording medium P below the liquid jet head unit 13. Then, the liquid 5*a* is jetted from the jetting portion 17 toward the recording medium P, the moving mechanism 14 makes the carriage 12 reciprocate above the recording medium P, and further, the recording medium P is moved in a direction perpendicular to the direction of the reciprocation of the carriage 12 in intervals of a certain amount by the transfer mechanism 27. This makes the liquid 5*a* jetted toward the whole surface of the recording medium P. At this time, the roller tube pump 7 is inactive and the tube 6 is closed by the rollers 9. Therefore, as illustrated in FIG. 2, when the liquid 5*a* is jetted, the pressure of the liquid 5*a* which flows through the tube 6 from the roller tube pump 7 to the jetting portion 17 is decreased.

The pressure sensor 22 measures the pressure value P1 which is the result of the combination of the above-described pressure decrease and the pressure fluctuations due to the movement of the liquid jet head unit 13 and the carriage 12 above the recording medium P, and continually sends the measured pressure value P1 to the control portion 11. The control portion 11 sends the received pressure value P1 to the determining portion 11*a*.

In the determining portion 11*a*, when the pressure value P1 is lower than the lower limit value X1, a drive signal of the normal rotation M1 according to the pressure value P1 is sent to the drive portion 11*b* (drive signal sending process S5). Then, the drive portion 11*b* drives the roller tube pump 7 in the normal direction. Then, the liquid 5*a* which flows through the tube 6 is pressed and moved toward the jetting portion 17 side. The pressing force is similarly transmitted to the jetting portion 17 and the pressure sensor 22.

On the other hand, when the pressure value P1 is higher than the upper limit value X4, a drive signal of the reverse rotation M4 according to the pressure value P1 is sent to the drive portion 11*b* (drive signal sending process S5). Then, the drive portion 11*b* drives the roller tube pump 7 in the reverse direction. Then, the liquid 5*a* which flows through the tube 6 is pressed and moved toward the liquid container side. The pressing force is similarly transmitted to the jetting portion 17 and the pressure sensor 22.

The pressure sensor 22 continually measures the pressure value P1 and sends the measured pressure value P1 to the control portion 11, and hence a slightly increased or decreased pressure value P1 is sent to the control portion 11. In the control portion 11, a series of processes from a pressure measuring process S3 to a feedback process S7 are repeated to exert feedback control. When the pressure value P1 is between the lower limit value X1 and the upper limit value X4, a drive signal of a stop M0 is sent to the drive portion 11*b*.

When the drive portion 11*b* receives a drive signal of the stop M0, the drive portion 11*b* stops the operation of the roller tube pump 7. In this way, the pressure value P1 is adjusted to be between the lower limit value X1 and the upper limit value X4.

As described above, the liquid jet recording apparatus 1 according to this embodiment measures the pressure value P1 of the liquid 5*a* which flows through the tube 6 between the liquid storing portion 26 and the roller tube pump 7 and drives the roller tube pump 7 to adjust the pressure value P1 to be in a range between the lower limit value X1 and the upper limit value X4. When the pressure value P1 is between the lower limit value X1 and the upper limit value X4, the pressure is damped by the liquid conduit 19 and the liquid storing portion 26, and thus, damping is carried out such that the pressure in the jetting portion 17 is in a range between the lower limit value X2 and the upper limit value X3, which is most appropriate for jetting. This makes it possible to maintain the function of adjusting the pressure of the liquid jetted from the jetting portion toward a recording medium and to, still, simplify the apparatus structure.

With such a structure, the liquid jet recording apparatus according to this embodiment can, even when the flow path is long and pressure loss in the flow path increases, measure the pressure value of the liquid 5*a* at the nozzle surface 16, and thus, the liquid 5*a* can be supplied with the pressure which is held appropriate.

Further, the liquid jet recording apparatus includes the liquid storing portion unit 15, and hence pressure fluctuations of the liquid 5*a* accompanying the movement of the carriage 12 can be suppressed. Further, as described above, the pressure of the liquid 5*a* which flows through the tube 6 between the liquid storing portion 26 and the roller tube pump 7 is measured and is adjusted to be between the lower limit value X1 and the upper limit value X4, and thus the pressure value in the jetting portion 17 can be made to be most appropriate for jetting. This makes it possible to prepare an appropriate printing environment, because, even when the influence of pressure loss due to increased flow path or the influence of pressure fluctuations due to the movement of the carriage remains, the liquid 5*a* can be supplied with the most appropriate pressure value at the nozzle surface 16.

Further, the method of controlling the pressure of the liquid 5*a* with the structure according to the present invention is carried out by pressurizing or depressurizing the liquid 5*a* in the tube 6 by the roller tube pump 7. Therefore, compared with a conventional method of controlling the pressure of the liquid 5*a* by introducing gas into the liquid container 5, deterioration of the liquid 5*a* due to exposure of the liquid 5*a* to the gas is suppressed, and the liquid can be jetted satisfactorily.

Further, according to the present invention, the most appropriate value of the pressure of the liquid 5*a* jetted from the jetting portion 17 is set to have a certain range (in the range of −0.5 kPa to −1.0 kPa in this embodiment). If a single value is set as the most appropriate value of the pressure, when, during a very small time lag from when the most appropriate value is indicated by the pressure sensor 22 to when the control portion 11 receives the pressure value and the roller tube pump 7 is stopped, the roller tube pump 7 pressurizes or depressurizes the liquid 5*a* and the pressure deviates from the most appropriate value in the opposite direction, frequent control may be carried out in order to decrease such minute pressure fluctuations. According to the present invention, the most appropriate value has a range and a mechanism to stop the roller tube pump 7 in the case of minute pressure fluctuations around the most appropriate value is adopted, and hence the above-described frequent control is not carried out.

Further, according to this embodiment, the lower limit value X1 and the upper limit value X4 are electromagnetically stored in the definition file Q and are rewritable, and hence, even when the damping characteristics are changed by replacing the liquid storing portion 26, the liquid conduit 19, or the like, by changing the definition file Q as appropriate, the pressure in the jetting portion 17 can be adjusted to be in an appropriate range.

Second Embodiment

Figure 4:
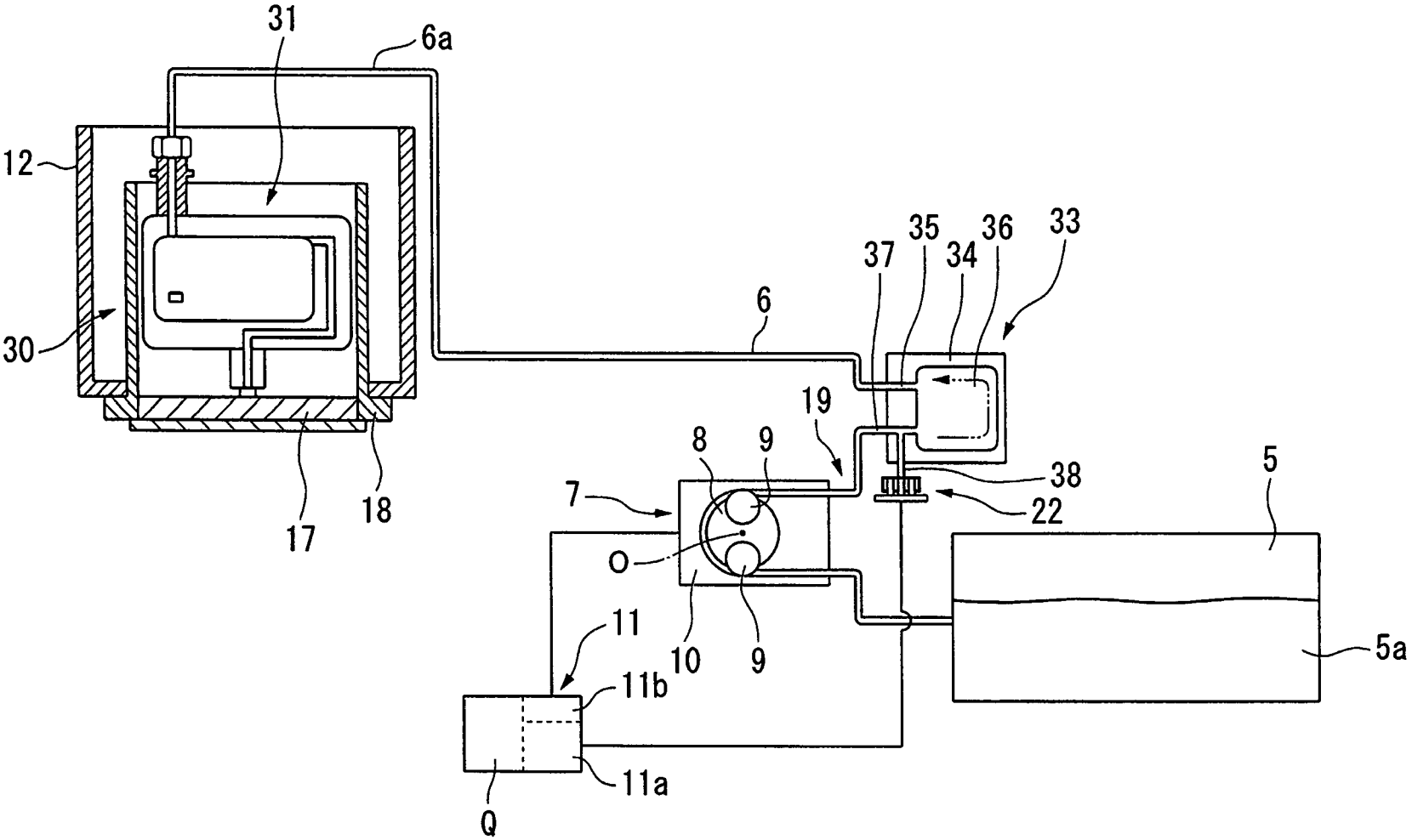
FIG. 4 is an explanatory view for describing a flow path of liquid in a liquid jet recording apparatus according to a second embodiment of the present invention.

Next, a liquid jet recording apparatus according to a second embodiment of the present invention is now described with reference to FIG. 4. It is to be noted that, in embodiments described in the following, common numerals and symbols are used to designate identical members in the structure of the first embodiment described above and description thereof is omitted. FIG. 4 is an explanatory view for describing a flow path of liquid in the liquid jet recording apparatus according to the second embodiment.

The structure of this embodiment is different from that of the first embodiment with regard to the following points.

First, a liquid storing portion unit 31 mounted on a liquid jet head unit 30 is a known filter type liquid storing portion.

Further, in this embodiment, the liquid container 5 and the roller tube pump 7 are fixed to a housing (not shown) of the liquid jet recording apparatus 1. A liquid storing portion unit 33 is fixed to a part of the housing on the side of the liquid jet mechanism 2 from the roller tube pump 7. The range of the pressure of the liquid 5*a* which can be damped by the liquid storing portion unit 33 is measured in advance similarly to the case of the first embodiment. Further, the liquid storing portion unit 33 includes a liquid storing portion case 34 and a liquid storing portion 36 housed in the liquid storing portion case 34.

The liquid storing portion case 34 has communicating portions 35 and 37. The communicating portion 37 is connected to the tube 6 and the liquid storing portion 36, and has a branch conduit 38 formed therefrom. A tip of the branch conduit 38 is connected to the pressure sensor 22. On the other hand, the communicating portion 35 is connected to a tube 6*a* and the liquid storing portion 36. The liquid 5*a* is adapted to flow from the liquid storing portion 36 to the jetting portion 17. The length of the flow path of the tube 6*a* from the liquid storing portion unit 33 to the jetting portion 17 is adjusted to be in a range of 50 mm to 600 mm.

With such a structure, similarly to the case of the first embodiment, the pressure value P1 of the liquid 5*a* which flows through the liquid conduit 19 between the liquid storing portion unit 33 and the roller tube pump 7 is measured by the pressure sensor 22, and the roller tube pump 7 is driven to adjust the pressure value P1 at the nozzle surface of the jetting portion 17 to be in a range between the lower limit value X2 and the upper limit value X3. This makes it possible to maintain the function of adjusting the pressure of the liquid jetted from the jetting portion toward a recording medium and to, still, simplify the apparatus structure.

Further, the housing includes the liquid storing portion unit 33 and the pressure sensor 22, and hence weight increase of the carriage 12 is suppressed, and thus, the amount of energy used when the carriage 12 scans above the recording medium P can be reduced.

Third Embodiment

Figure 5:
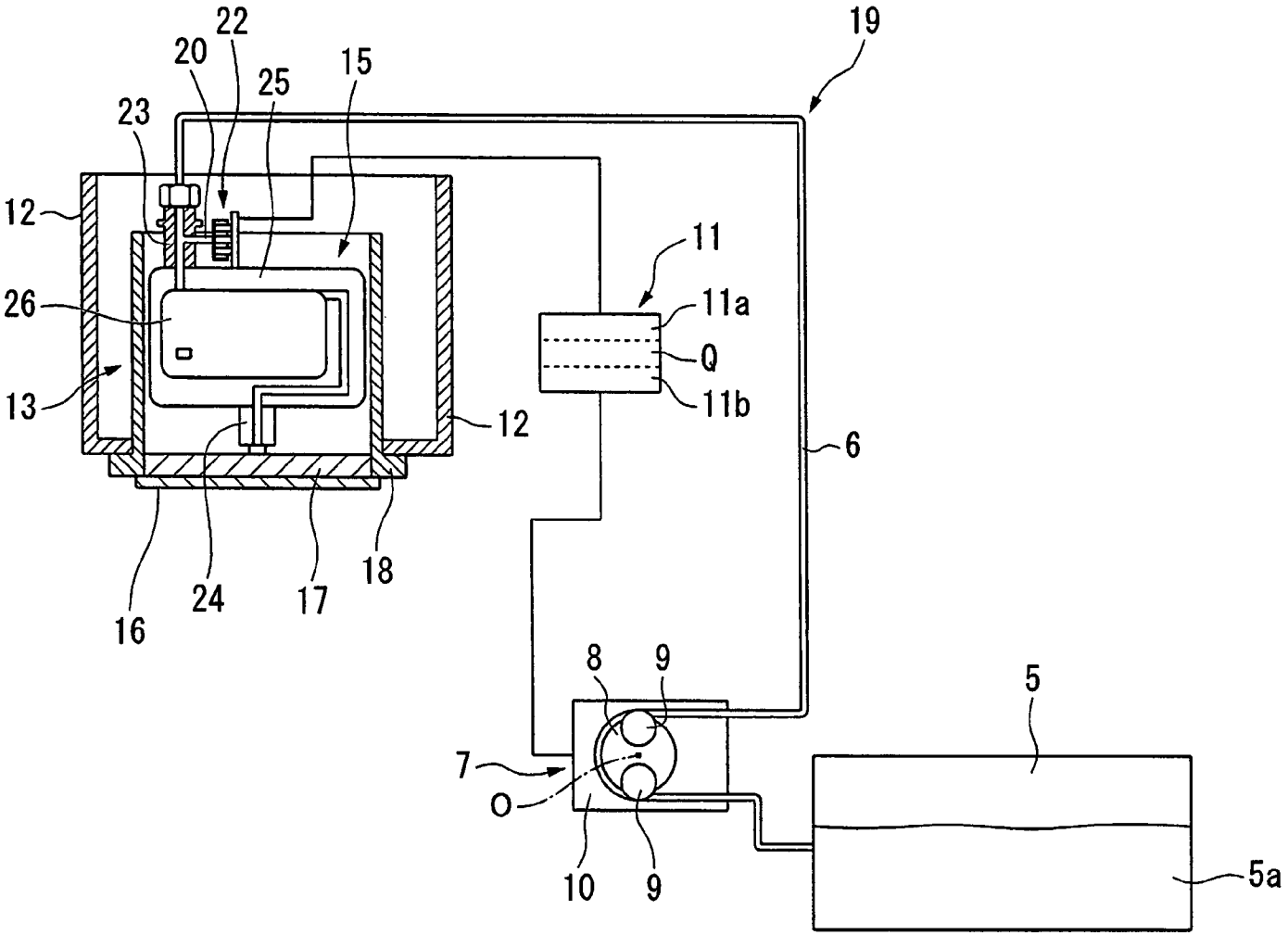
FIG. 5 is an explanatory view for describing a flow path of liquid in a liquid jet recording apparatus according to a third embodiment of the present invention.

Next, a liquid jet recording apparatus according to a third embodiment of the present invention is now described with reference to FIG. 5. FIG. 5 is an explanatory view for describing a flow path of liquid in the liquid jet recording apparatus according to the third embodiment.

The structure of this embodiment is different from that of the first embodiment in that, as illustrated in FIG. 5, a communicating portion 23 has a branch conduit 20 formed therefrom and a tip of the branch conduit 20 is connected to the pressure sensor 22. In other words, in this embodiment, the pressure sensor 22 which is pressure measuring means is adapted to be moved integrally with the carriage 12.

In the definition file Q, the lower limit value X1 and the upper limit value X4 are set taking into consideration the damping ability of the liquid conduit 19 from the communicating portion 23 at which the pressure sensor 22 is provided to the jetting portion 17 and of the liquid storing portion 26.

With such a structure, the pressure value P1 of the liquid 5*a* sent from the pressure sensor 22 is compared with the lower limit value X1 and the upper limit value X4 stored in the definition file Q and control is exerted similarly to the case of the first embodiment, and hence the pressure of the liquid 5*a* in the nozzle of the jetting portion 17 is controlled to be between the lower limit value X2 and the upper limit value X3.

Embodiments according to the present invention are described in detail with reference to the attached drawings in the above. However, specific structures are not limited thereto and various modifications including design changes can be made without departing from the gist of the present invention.

For example, in the embodiments according to the present invention, the target values of the pressure controlled by the control portion 11, that is, the pressure values at the nozzle surface of the jetting portion 17 are most appropriately the upper limit value X3 of −0.5 kPa and the lower limit value X2 of −1.0 kPa, but the precision of the jetting of the liquid 5*a* may be satisfied also when the target values are set to be +0.5 kPa and −2.0 kPa. In this case, by extending the range of the target value, the frequency of driving the roller tube pump 7 for adjusting the pressure can be decreased.

Further, though, in the embodiments according to the present invention, the adopted structure of the roller tube pump 7 is such that the tube 6 is disposed on the outer periphery of the wheel 8 and pressed by the rollers 9, the present invention is not limited thereto. For example, a middle portion of a flexible tubular member may be disposed along a part of the outer periphery of the wheel and pressed by the rollers, with a roller tube pump having both ends opened as connecting openings being in the middle portion of the tube 6.

Further, though, in the embodiments according to the present invention, a roller tube pump having two rollers 9 is adopted as the pump for pressurizing and depressurizing the liquid 5*a* in the tube 6, the present invention is not limited thereto. A roller tube pump having more than two rollers 9 may be adopted, or a pump mechanism other than the roller tube pump may pressurize or depressurize the liquid 5*a* in the tube 6.

Further, though, in the embodiments of the present invention, a structure in which, by forming the branch conduit 20 in a part of the liquid storing portion case 25 and by connecting the pressure sensor 22 to the tip of the branch conduit 20, the pressure sensor 22 is connected adjacently to the liquid storing portion 26 is adopted, the present invention is not limited thereto. An appropriate structure in which the pressure sensor 22 is in an arbitrary part of the liquid conduit 19 between the liquid storing portion 26 and the roller tube pump 7 to measure the pressure of the liquid 5*a* may be adopted. Further, with regard to the length of the branch conduit 20, even when an appropriate structure in which the length of the flow path of the liquid 5*a* from the jetting portion 17 to the pressure sensor 22 is from 50 mm to 600 mm is adopted, pressure measurement with the precision of the jetting of the liquid 5*a* being satisfied is possible.

Further, though, in the embodiments of the present invention, the liquid container 5 is adopted as the container of the liquid, the present invention is not limited thereto. For example, a liquid supply mechanism including a main tank for containing a relatively large amount of liquid and an auxiliary tank connected via a tubular member to the main tank for containing part of the liquid contained in the main tank may be adopted.

Further, though, in the embodiments of the present invention, a structure in which the definition file Q is stored in a rewritable nonvolatile memory circuit such as a flash memory or an EPROM is adopted, the present invention is not limited thereto, and an appropriate storing method in which information of the definition file Q is stored in a nonvolatile way and rewritable may be adopted.

Further, though, in the embodiments of the present invention, a structure in which the respective values of the lower limit value X1 and the upper limit value X4 are stored in the definition file Q in the control portion is adopted, the present invention is not limited thereto. A structure in which the lower limit value X2, the upper limit value X3, and a computational expression for producing the lower limit value X1 and the upper limit value X4 from the lower limit value X2 and the upper limit value X3 are stored and the determining portion 11*a* is adapted to produce the lower limit value X1 and the upper limit value X4 using the computational expression may be adopted, or, a structure in which the definition file Q is a table describing the relationship between the pressure value P1 measured by the pressure sensor 22 and the actual pressure value in the jetting portion 17 may be adopted.

Further, though, in the second embodiment of the present invention, a structure in which the known liquid storing portion unit 31 is mounted on the liquid jet head unit 30 is adopted, however, in this structure, the known liquid storing portion unit 31 does not increase the pressure fluctuations of the liquid 5*a*, and hence, by adjusting the pressure by the structure of this embodiment, the pressure of the liquid 5*a* is appropriately adjusted. However, the present invention is not limited thereto, and, even when the liquid storing portion unit 33 and the pressure sensor 22 according to the present invention are mounted on the housing and the liquid storing portion unit 31 is not mounted on the liquid jet head, the effect of the present invention can be achieved. Further, it is also possible to mount the liquid storing portion unit 33 on the carriage 12.

What is claimed is:

1. A liquid jet recording apparatus comprising:

a liquid container for containing liquid;

a jetting portion for jetting the liquid toward a recording medium;

a liquid conduit for communicating the jetting portion with the liquid container;

pressure adjusting means for adjusting the pressure of the liquid which flows through the liquid conduit;

a liquid storing portion disposed in the liquid conduit between the pressure adjusting means and the jetting portion for damping pressure fluctuations of the liquid;

pressure measuring means disposed in the liquid conduit between the liquid storing portion and the pressure adjusting means for measuring the pressure of the liquid which flows through the liquid conduit; and a control portion electrically connected to the pressure measuring means and the pressure adjusting means, wherein the control portion includes a setting portion for indicating the pressure fluctuations of the liquid from a position at which a measurement is made by the pressure measuring means via the liquid storing portion to the jetting portion, and, based on information set in the setting portion and a pressure value measured by the pressure measuring means, controls the pressure adjusting means so that the pressure of the liquid in the jetting portion is in a predetermined range.

2. A liquid jet recording apparatus according to claim 1, further comprising a branch conduit disposed in a part of the liquid conduit between the pressure adjusting means and the liquid storing portion, wherein the pressure measuring means is connected to a tip of the branch conduit and is connected via the branch conduit to the liquid conduit.

3. A liquid jet recording apparatus according to claim 1, wherein the pressure measuring means is connected to the liquid storing portion.

4. A liquid jet recording apparatus according to claim 1, wherein the pressure measuring means is connected adjacently to the pressure adjusting means.

5. A liquid jet recording apparatus according to claim 1, further comprising a carriage, the jetting portion being fixed to and supported by the carriage and the carriage being movable above the recording medium, wherein the liquid storing portion is fixed to the carriage.

6. A liquid jet recording apparatus according to claim 1, wherein the liquid storing portion is fixed to a liquid supply mechanism including the liquid container and the pressure adjusting means.

7. A liquid jet recording apparatus according to claim 1, wherein the liquid storing portion is disposed adjacently to the pressure adjusting means.

8. A liquid jet recording apparatus according to claim 1, wherein the setting portion includes a table indicating a relationship between the pressure value measured by the pressure measuring means and a pressure value of the liquid in the jetting portion.

9. A liquid jet head unit used in the liquid jet recording apparatus according to claim 1, comprising:

the jetting portion;

the liquid storing portion; and the pressure measuring means, wherein the jetting portion, the liquid storing portion, and the pressure measuring means are fixed and supported on a frame of the apparatus.

10. A liquid jet recording method using the liquid jet recording apparatus according to claim 1, comprising:

monitoring the pressure value indicated by the pressure measuring means and measuring the pressure of the liquid;

determining whether or not the pressure of the liquid is between an upper limit pressure value and a lower limit pressure value which are set in advance; and stopping operation of the pressure adjusting means when the pressure of the liquid is between the upper limit pressure value and the lower limit pressure value, pressurizing the liquid toward the jetting portion by the pressure adjusting means when the pressure of the liquid is lower than the lower limit pressure value, and pressurizing the liquid toward the liquid container by the pressure adjusting means when the pressure of the liquid is higher than the upper limit pressure value.

11. A liquid jet recording method according to claim 10, wherein the upper limit pressure value and the lower limit pressure value are set with regard to the pressure value of the liquid in the nozzle.

12. A liquid jet recording method according to claim 11, wherein the upper limit pressure value is +0.5 kPa and the lower limit pressure value is −2.0 kPa.

13. A liquid jet recording method according to claim 11, wherein the upper limit pressure value −0.5 kPa and the lower limit pressure value is −1.0 kPa.

* * * * *